US006253526B1

(12) United States Patent
Murphy et al.

(10) Patent No.: US 6,253,526 B1
(45) Date of Patent: Jul. 3, 2001

(54) INSTALLATION METHOD FOR CARPET UNDERLAYS

(75) Inventors: Peter Michael Murphy, Ooltewah, TN (US); Joyce Monson Materniak, Hockessin, DE (US); Anne Dowdell Cathey; Misty Dawn Dittman, both of Cleveland, TN (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/191,658

(22) Filed: Nov. 13, 1998

(51) Int. Cl.[7] ..... E04G 23/00; E04F 15/00
(52) U.S. Cl. ..... 52/741.4; 52/506.05; 52/741.1
(58) Field of Search ..... 52/741.1, 746.1, 52/177, 741.4, 506.01, 506.05; 428/95, 96, 97; 442/79, 80, 81, 82, 84

(56) References Cited

U.S. PATENT DOCUMENTS

| | | | |
|---|---|---|---|
| 2,225,906 | 12/1940 | Dallia | 154/49 |
| 3,923,715 | 12/1975 | Dettre et al. | 260/29.6 R |
| 4,014,645 | 3/1977 | Chancler et al. | 8/17 |
| 4,029,585 | 6/1977 | Dettre et al. | 252/8.6 |
| 4,206,007 | 6/1980 | Force | 156/72 |
| 4,360,554 | 11/1982 | Campbell et al. | 428/91 |
| 4,412,877 | 11/1983 | Vosburgh | 156/72 |
| 4,595,518 | 6/1986 | Raynolds et al. | 252/8.6 |
| 4,619,853 | 10/1986 | Blyth et al. | 428/95 |
| 4,742,140 | 5/1988 | Greenwood et al. | 526/245 |
| 4,958,039 | 9/1990 | Pechhold | 556/421 |
| 5,344,903 | 9/1994 | Raiford et al. | 526/245 |
| 5,348,785 | 9/1994 | Vinod | 428/95 |
| 5,601,910 * | 2/1997 | Murphey et al. | 442/79 |

FOREIGN PATENT DOCUMENTS

| | | | |
|---|---|---|---|
| 520308 | 6/1953 | (BE) . | |
| 520308 | 7/1955 | (BE) . | |
| 333 396 | 9/1989 | (EP) | D06N/7/00 |
| 2 576 506 | 8/1986 | (FR) | A47G/27/04 |
| 2 576 506 A1 | 8/1986 | (FR) . | |
| 518 890 A | 3/1940 | (GB) . | |
| 521287 | 5/1940 | (GB) . | |
| WO 96/33307 | 10/1996 | (WO) . | |

* cited by examiner

*Primary Examiner*—Michael Safavi

(57) ABSTRACT

A process for installing a carpet underlay resistant to water requires placing a padding over a floor, mechanically securing the padding to the floor and placing an underlay over the padding. The underlay is formed of a water resistant fabric or water resistant film. The fabric being treated with a water repellent finish. The resulting fabric or film being resistant to water such that 20 ml of water poured on a sample of the underlay from a height of 6 cm results in no wet spot after 10 minutes, or results in a wet spot having a maximum diameter of 2.54 cm, on a paper towel located directly beneath the location on the underlay on which the water has been poured.

23 Claims, No Drawings

INSTALLATION METHOD FOR CARPET UNDERLAYS

FIELD OF THE INVENTION

This invention relates to a process for installing carpet having water resistant or impermeable underlays.

BACKGROUND OF THE INVENTION

Water resistant and impermeable carpet underlays provide a way to clean spills on carpet more thoroughly by containing the spill above the padding, thus preventing the spill from wetting the padding and flooring underneath. The resistant or impermeable barrier provides advantages since, if a spill is not removed from under the carpet, the spill will allow the growth of mold, mildew, and bacteria. Such underlays may be treated with antibacterial and antifungal agents. Not only may the padding and wood flooring deteriorate as a result, but such conditions are conducive to the formation of odors and allergens.

Spills on fitted or wall-to-wall carpeting are particularly insidious since detection and prevention of the seepage into the padding following a spill is typically impractical with large or fitted carpets. A spill on broadloom carpeting often puddles on the padding or flooring where it can not be removed by cleaning.

This spill then accelerates the growth of mold, mildew and odors. By allowing spills to be more thoroughly cleaned, a water resistant or impermeable backing reduces the growth of mold and mildews which cause odors.

Murphy, in U.S. Pat. Nos. 5,601,910 and 5,763,040, described processes to treat a carpet underlay to make it substantially impermeable to spills. By careful selection of both the water repellent finish and adhesive, the water impermeable underlay was adhered to the underside of the carpet creating a barrier to spills.

Underlays are usually attached to the underside of the carpet by an adhesive applied to the upper side of the underlay. Alternatively the underlay may be treated with adhesive on both sides to attach it to both the underside of the carpet and the padding. The adhesive prevents movement of the underlay as the carpet is laid, and also prevents any movement due to traffic after the installation is complete. Such application methods have been highly effective, but there are added costs associated with the adhesive, necessary release papers, and installation.

The prior art also describes water impermeable carpeting constructed using impermeable backings such as those based on poly(vinyl chloride) and polyurethane to replace the usual latex backing, and also sheets of plastic, such as polyethylene and poly(ethylene/vinyl acetate), that are laminated to the carpet.

However, such backings are expensive, create manufacturing difficulties, and prevent desirable breathability (air permeability) of the carpet.

It would be advantageous if a simpler method for laying the padding, underlay, and carpet were available which would reduce the costs associated with the adhesive, necessary release papers, and installation. The present invention provides such an improved process for installation of a water resistant or water impermeable underlay with padding and carpet.

SUMMARY OF THE INVENTION

The present invention comprises a process for installing a carpet underlay resistant to water comprising a) placing a padding over a flooring, and optionally securing said padding into the flooring, b) placing an underlay over said padding, and c) mechanically securing the underlay through said padding into the flooring with fasteners, wherein said underlay comprises a water resistant fabric or film, whereby said resistance is measured by pouring 20 ml of water on a test sample of carpet at a location over an underlay fastener from a height of 6 cm and results in no wet spot after 30 minutes, or a wet spot having a diameter of a maximum of 2.54 cm on a paper towel placed between the underlay and the padding directly beneath the location on which said water has been poured.

The present invention further comprises a process for installing a carpet underlay impermeable to water comprising a) placing a padding over a flooring, and optionally securing said padding into the flooring, b) placing an underlay over said padding, and c) mechanically securing the underlay through said padding into the flooring with fasteners, wherein said underlay comprises a water impermeable fabric or film, whereby said impermeability is measured by pouring 20 ml of water on a test sample of underlay at a location over an underlay fastener from a height of 6 cm and results in no wet spot after 10 minutes, or a wet spot having a diameter of a maximum of 2.54 cm on a paper towel placed between the underlay and the padding directly beneath the location on which said water has been poured.

The present invention further comprises the product of the above processes.

DETAILED DESCRIPTION OF THE INVENTION

The process of the present invention comprises stapling, nailing, or otherwise mechanically attaching an underlay through padding to the flooring using fasteners. Hereinafter, the terms "secure", "secured", "securing", "securement" are used to describe aspects of the attachment of the underlay by means of staples, nails, or other mechanical means of attachment. Specifically excluded is the use of adhesive or adhesive tape as a means of attachment of the underlay. By the term "flooring" is meant any surface to be carpeted.

In the present invention carpet padding is laid conventionally. The underlay, without adhesive, is secured through the padding to the flooring, and the carpet is laid conventionally on the secured underlay. The present invention simplifies the installation of water resistant and water impermeable underlays by securing the underlay fabric to the padding and underneath flooring without compromising the integrity of the water resistant or water impermeable barrier, even though securing, as used in the context of this invention, punches holes in the underlay.

The terms "water resistant" and "water resistance", as applied hereinafter to underlays, mean that the underlay, under the conditions of Test Method 3 described hereinafter, prevents the penetration of water through the underlay into the underlying padding. It is understood that water resistant means resistant to water and aqueous solutions and suspensions, including coffee, wine, soda, fruit juices, urine, and the like. More specifically, the terms water resistant and water resistance mean that, under the conditions of Test Method 3, the wet spot diameter on the paper towel after 30 minutes is one inch (2.54 cm) or less. Test Method 3 comprises testing carpet and secured underlay and padding.

The terms "water impermeable" and "water impermeability" as used herein applied to underlays mean that the underlay, under the conditions of Test Method 4 described hereinafter, prevents the penetration of water through the underlay into the underlying padding. It is understood that water impermeable means impermeable to water and aqueous solutions and suspensions, including coffee, wine, soda, fruit juices, urine, and the like. More specifically, the terms water impermeable and water impermeability mean that, under the conditions of Test Method 4, the wet spot diameter on the paper towel after 10 minutes is one inch (2.54 cm) or less. Test Method 4 comprises testing secured underlay and padding without carpet. Test Method 4 is more stringent than Test Method 3 since, in Test Method 3, the tendency for water to penetrate is reduced as it is at least partially absorbed by the carpet.

The process of the present invention provides several advantages. It (i) allows fabrics without adhesive to be used as water resistant or water impermeable underlays, (ii) simplifies the installation of the underlay, (iii) preserves the integrity of the water resistant or water impermeable barrier at seams between adjacent sheets of the underlay, (iv) eliminates the need for release sheets on the adhesive coated side or sides of the underlay, (v) eliminates the nuisance of the adhesive coated fabric sticking to itself, (vi) holds the underlay more firmly to the padding and underneath flooring, and (vii) allows the flexibility to install the underlay just in desired areas.

Carpeting requires a solid foundation to increase comfort and durability, reduce noise, and provide insulation. Commercial padding is usually ¼ in. (0.6 cm) thick, residential padding typically has a maximum thickness of 7⁄16 in. (1.1 cm).

Padding suitable for use in the practice of this invention is available in a number of forms well known to those skilled in the trade, constructed of various forms of rubber and urethane, felted combinations of hair and jute, and fiber. The padding is laid and attached to the flooring conventionally, e.g., for wood flooring with metal staples placed about every 8 in. (20 cm) along the perimeter to prevent the padding from moving, buckling, or tearing during or after installation.

Water resistant and water impermeable fabrics useful in the underlays used in the practice of this invention require certain properties to insure that they will perform properly for the intended use. These properties include high tear strength, high abrasion resistance, high water resistance and water impermeability, high hydrostatic head and high water repellency, ease of installation (including seaming), and good breathability. Such fabrics include woven fabrics, knitted fabrics, felting, paper or nonwoven fabrics such as spunbonded webs, melt blown webs, resin bonded fabrics, random-laid short cut-length fiber webs, tissue and scrim laminates, spunlaced webs, dry laid fiber webs, needlepunched fabrics, cellulosic fabrics, or mixtures or laminates thereof. For purposes of this invention paper is considered an underlay fabric. The underlay fabric comprises fibers selected from cotton, wool, jute, polyolefin, acrylic polymers, cellulosic, nylon, polyester, and mixtures thereof. Short cut-length fiber is frequently termed staple fiber. Preferred underlay materials are nonwoven materials. Most preferred are spunlaced nonwoven materials such as "SONTARA" available from E. I. du Pont de Nemours and Company, Wilmington, Del., and a laminate of spunbonded/melt blown/spunbound nonwoven fabrics. Nonwoven materials also have a lower cost of manufacture for a given coverage as compared to more conventional textile fabrics made by weaving, knitting or felting.

Suitable commercially available impermeable films useful in the underlays used in the practice of this invention include, but are not limited to, films made from synthetic polymers such as acrylics, polyester, polyolefin, polycarbonates, cellulose acetate, fluoroplastics, polystryene, polyvinyl chloride, poly(ethylene/vinyl acetate), nylon and laminates thereof. These are available from Dayton Plastics Incorporated, Dayton, Ohio or Laird Plastics Company, Seattle, Wash.

Suitable water repellent finishes or treatments for use herein on the underlay fabrics include polymers or other compounds with molecular weight greater than 500 having pendent or terminal groups of perfluoroalkyl moieties. Examples of some suitable fluorochemicals include: polymers and copolymers of vinylidene fluoride, tetrafluoroethylene, perfluoroalkylethyl acrylates, perfluoroalkylethyl methacrylates, mixtures of the same; blends of the foregoing polymers and copolymers with polymers and copolymers of alkyl acrylates and alkylmethacrylates, copolymers of vinylidene chloride, vinylidene fluoride, tetrafluoroethylene, perfluoroalkylethyl acrylates and perfluoroalkylethyl methacrylates. Other water repellent finishes suitable for use herein include silicones, wax emulsions, naturally occurring oils, alkylacrylate resins, and hydrophobic alkylmethacrylate resins. Mixtures of the preceding types of water repellent finishes can also be used.

Other chemical additives are typically present in the repellent finish bath and may include surfactants, sequestrants, pH adjusters, antimicrobials, fragrances, viscosity modifiers, dyes, and other conventional bath additives.

Many commercially available fluorochemicals are used as water repellent finishes in the practice of this invention. These include commercially available proprietary products sold under the tradenames of "TEFLON" and "ZONYL" from E. I. du Pont de Nemours and Company, Wilmington, Del.; "MILEASE" from ICI, Wilmington, Del.; "ASAHIGARD" from Asahi Glass, Plymouth, Mich.; "SCOTCHGARD" from 3M, Minneapolis Minn.; "SOFTECH" from Dyetech, Dalton, Ga.; "TEX-TEL" from Atochem, Philadelphia, Pa.; "UNIDYNE" from Diaken, Osaka, Japan; and "NK GUARD" from Nicca, Fountain, S.C. Suitable commercially available silicone-based repellents include, but are not limited to, C2-0563 from Dow Corning, Midland, Mich. Dow Corning C2-0563 is a silicone repellent mixture of polydialkylsiloxanes. Suitable commercially available wax emulsions include those sold under the trademark "NALAN" from E. I. du Pont de Nemours and Company, Wilmington, Del., and "OCTOWAX" 312 from Tiarco Chemical Co, Dalton, Ga. Suitable commercially available naturally occurring oils include coconut oil and corn oil from Columbus Foods, Chicago, Ill. Suitable hydrophobic acrylate resins include water repellent polymers and copolymers of acrylic acid esters and methacrylic acid esters such as the methyl, but preferably ethyl and butyl, esters. Mixtures of these polymers and copolymers are also effective. One example of a commercially available resin is "Acrylic Matte Medium" from Golden Artist Colors, Hamilton, N.Y.

Tradenames and trademarks are indicated herein by capitalization and quote marks.

Preferred water repellent finishes are primarily fluorochemicals and include the following aqueous dispersions: fluoroalkyl urethanes as disclosed in U.S. Pat. No. 4,595,518 (water repellent finish #1 or WRF-1 in the Examples and tabulated results below); blends of wax, a diethylaminoethyl methacrylate/hexadecyl methacrylate/octadecyl methacrylate copolymer and a fluoroalkyl methacrylate copolymer of the type disclosed in U.S. Pat. No. 4,595,518 (WRF-2);

aqueous dispersions of a hydrocarbon wax (WRF-3); blends of fluoroalkyl citrate-urethane and polymethylmethacrylate as disclosed in U.S. Pat. No. 3,923,715 (WRF-4); polyfluoro organic compounds prepared by reacting a polyisocyanate with a fluoroalcohol and water as disclosed in EP-A-453641 (WRF-5); fluoroalkyl polyacrylates as disclosed in U.S. Pat. No. 4,742,140 (WRF-6); fluoroalkyl polymethacrylates as disclosed in U.S. Pat. No. 5,344,903 (WRF-7), and perfluoroalkyl methacrylate polymers of the type disclosed in U.S. Pat. No. 5,674,961 (WRF-8).

The techniques for matching repellent finishes with the fabric composition are well known in the art. Typically the repellent finish is diluted with water or a suitable solvent such as alcohol for application to the underlay, with water being preferred. The necessary dilution is determined by the wet pick-up and the required concentration of active ingredient in the dried and cured underlay. The wet pick-up is the amount of repellent finish in the wet underlay after application of the bath but before drying or curing. The wet pick-up is expressed as a percentage based on the dry fiber. For instance, a repellent finished underlay is to contain 1.5% of the active ingredient and the wet pick-up is 200%. In this instance, the repellent finish as applied contains 100×1.5/200 or 0.75% active ingredient.

The amount of repellent finish, together with the necessary diluent such as water or alcohol that is applied to the underlay, is measured as a percentage of the dry weight of the underlay and is termed "wet pickup". The wet pick-up applied to the underlay fabric is generally in the range of 20 to 500% by weight, and preferably 50 to 200% by weight, based on the untreated or unfinished underlay fabric. Typically, commercially available repellent finishes contain about 0.5 to about 40% by weight total active ingredient. In the case of silicones, the total active ingredient may be greater than 40% by weight. In this invention, the amount of active ingredient of repellent finish applied is generally in the range of about 0.01 to 10% by weight, and preferably 0.05 to 3% by weight, of the active ingredient in the repellent finish based on the underlay.

However, it is understood that the amount of repellent finish and active ingredient applied is adjusted depending on the type and concentration of the repellent, the underlay construction and weight, and the type of fiber or fibers in the underlay. In any application, it is important that a sufficient amount of repellent finish be uniformly applied to the underlay such that the repellent finished underlay is resistant and/or impermeable to water, according to Test Methods 3 and 4.

The repellent finish is applied to the underlay by various means including immersion (also termed "padding"), foam, spray, or dipping processes, followed by a heat treatment to dry or cure the repellent finish, typically in an oven. The drying temperature, drying temperature profile, and drying time are selected, based on the thermal stability of the fabric and the drying and curing properties of the repellent finish, to be sufficient to accomplish the necessary drying and curing. Control of such drying parameters are well known to those skilled in the art.

It is necessary to ensure that the repellent finish be completely and uniformly applied to the underlay, and completely and uniformly dried and cured. Immersion, in which the underlay is dipped in a bath and the excess repellent finish squeezed off, typically gives excellent and uniform application and is thus the preferred application method. Foam and spray applications, on the other hand, can allow starved or missed areas unless the foam or spray is very carefully applied. Even very small undertreated areas will impair the repellency and impermeability desired. To ensure foam and spray applications are complete, it may be necessary to apply the repellent finish with greater wet pick-up than would be necessary for immersion. However, when the spray or foam repellent finish bath is diluted with extra water compared with the immersion process, extra drying is required. For foam and spray applications, a wetting agent is often added to the repellent finish to assist in the complete and uniform application. Suitable wetting agents are exemplified by "ALKANOL 6112" (poly (oxyethylene sorbitan monooleate in water/1-decanol, available from E. I. du Pont de Nemours & Company, Wilmington Del.). Wetting agents were not necessary in the preferred immersion application. After drying and curing, the carpet underlay is now repellent and/or impermeable to water or aqueous solutions and suspensions.

For broadloom carpeting, the padding is first installed over flooring, the underlay is installed over the padding, and the carpeting is installed over the underlay. In the practice of this invention, the water resistant or water impermeable underlay is laid over the padding, and secured through the padding to the flooring using fasteners, securing along the edges and seams of the underlay at an appropriate spacing as described in the method for determining spacing described below. Optional securing elsewhere over the surface of the underlay is added as deemed necessary. Suitable fasteners are staples, nails, taped-over staples, taped-over nails, and equivalent devices.

A method for establishing the staple or nailing pattern or interval versus the overlap width of adjacent underlay sheets has been determined. The following stapling or nailing procedure provides impermeability at underlay seams and tears. For the installation of broadloom carpeting with padding and impermeable underlay, the following sequence is preferred:

(1) either the padding is placed over the flooring, or the padding is generally secured over the flooring, e.g., using staples over a wood flooring, (2) the underlay is mechanically secured through the padding to the underneath flooring using staples or nails, and (3) the carpeting is installed over the underlay and secured at the edges of the room with tackless strips.

Tackless strip is a thin strip of wood, about 2 in. (5.1 cm) wide, that is nailed to the flooring around the perimeter of the carpeted area. The upper surface of the tackless strip comprises angled small pins, of length about ½ in. (1.3 cm), facing towards the wall or carpet perimeter and over which the carpet edge is stretched.

In many cases, the size of the room where the underlay is to be installed will be larger than the width of a single roll or sheet of underlay. In order to provide a water repellent and/or water impermeable barrier across the entire room, two or more rolls or sheets of underlay will need to be installed side by side. For these installations, the water repellent and/or water impermeable barrier at the seam between adjacent rolls or sheets is critical to maintain the water repellent and/or water impermeable barrier of the overall carpet underlay. The underlay is placed over the padding in two or more segments in a manner to create an overlap at the seam between adjacent segments. The underlay is then mechanically secured through the padding into the flooring at the location of the overlap. While each underlay can have a slightly different stapling or nailing pattern at their seams depending on its elasticity, these general guidelines are applicable to the majority of underlays. The wider the underlay overlap at the seam, the greater is the acceptable distance between staples or nails without compromising the water repellency and/or water impermeability of the underlay at the seam. The water repellency and/or water impermeability of the underlay is compromised at the seam if the top layer is able to separate and allow a gap between the staples or nails where the top layer of underlay can fold over and expose the underneath padding.

The preferred method for testing the integrity of a seam between adjacent layers of underlay is to pull or fold the upper layer of underlay away from the seam between adjacent staples or nails as far as the underlay will stretch or fold without tearing the underlay. If a large enough gap forms that the underneath padding can be seen, then either the gap between adjacent staples needs to be reduced or the width of the overlap between the top and bottom layer of underlay needs to be increased. Conversely, if only a small gap forms when the upper layer of underlay is pulled or folded away from the seam and this small gap is much smaller than that required to expose the underneath padding, then either the gap between adjacent staples can be increased or the width of the overlap between the top and bottom layer of underlay can be reduced.

For example, for Comparative Example A, the following Table 1 defines the relationship between overlap width of the top and bottom layers of underlay at the seam and maximum staple distance which prevents separation at the seam.

TABLE 1

Staple Pattern for Comparative Example A

| Fabric Overlap in. (cm) | Maximum Staple Separation for Seam Integrity in. (cm) |
|---|---|
| 1 (2.5) | 4 (10.2) |
| 2 (5.1) | 7 (17.8) |
| 3 (7.6) | 15 (38.1) |
| 4 (10.2) | 24 (61.0) |

In the same way, even a small rip or tear or cut in the underlay can compromise the water repellency and/or water impermeability of the carpet underlay. These rips, cuts, and tears can be repaired by cutting a section of underlay approximately at least 3 in. (8 cm) larger than the rip or cut or tear in every direction. This section of underlay is centered over the rip or cut or tear and secured through the padding to the underneath flooring using staples or nails to hold this section of underlay in place both during and after installation of the carpet and to prevent folding or pulling back of this section of underlay to expose the rip or cut or tear.

The process of this invention clearly punches holes through the underlay and the securing positions create slight depressions in the underlay where water spills may pool at these perforations. However, the use of certain underlays such as fabrics in which the fibers have been surface-treated or finished with fluorochemicals, silicones, and/or waxes, typically having a low surface energy, are found not to compromise the integrity of the water resistant and/or water impermeable barrier. When the underlay is a film, the process of this invention does not compromise the water impermeability of the film.

When the invention is practiced using staples, conventional staples are used, typically of ¼–15/16 in. length (0.6–2.4 cm) as available from such companies as Arrow Fasteners (Saddlebrook, N.J.) or Hunt Manufacturing Co. (Statesville, N.C.). Staples are optionally sealed with tape (taped-over). Alternatively, nails, nails with washers or nails sealed with tape (taped-over) are suitable for use herein. Examples of the types of nails, washers and tapes readily available at local hardware stores and appropriate for use in the present invention are shown in Table 2 below.

TABLE 2

Securing Devices Using Nails with Washers or Tape

| Nail Code | Length (cm) | Head Size (cm) | Description |
|---|---|---|---|
| N1 | 2.3 | 1.0 | small roofing nail |
| N2 | 1.7 | 0.5 | carpet tack |
| N3 | 1.5 | 1.0 | rounded head upholstery tack |
| N4 | 1.3 | 0.3 | medium tack |
| N5 | 1.9 | 0.6 | large tack/small nail |
| N6 | 2.5 | 1.1 | small roofing nail |

| Washer Code | Material | Outer Diameter (cm) |
|---|---|---|
| W1 | rubber | 3.2 |
| W2 | rubber | 1.9 |
| W3 | rubber | 1.0 |
| W4 | metal over rubber | 1.4 |
| W5 | metal | 1.0 |
| W6 | metal | 1.6 |
| W7 | metal | 2.3 |

| Tape Code | Material Description |
|---|---|
| T1 | Duct tape from Polyken Technologies, Mansfield, Massachusetts |
| T2 | Brown packaging tape from Manco Inc., Westlake, Ohio |
| T3 | Paper tape from Maco Address Label LL-3000, Hillside, New Jersey |

Any washers made from impermeable material such as plastic, rubber, or metal are suitable for use herein. The washers are placed so as to be seated around the nail shaft and directly under the head of the nail. Any type of water impermeable tape is suitable for use herein. Adhesive tape is used to cover the staple or nail head, using a piece of tape not less than 1.5 in. square (3.8 cm square).

Finally, the carpet is then installed conventionally over the secured water resistant and/or water impermeable underlay, for instance using tackless strip to hold the carpet in place.

The product of this invention comprises a water resistant or water impermeable underlay, secured through the padding to the flooring, and ready for carpeting to be laid over the underlay. The invention makes a separate stapling of the padding to the flooring optional. The underlay and padding are then ready for conventional installation of carpeting.

TEST METHODS

Test Method 1. Water Repellency (DuPont TEFLON Standard Test Method No. 311.56)

The underlay specimen is held at a temperature of 21° C.±1° C. (70° F.±2° F.) and at a relative humidity of 65%±2% for at least four hours and is then placed on a flat level surface. Three drops of the selected water/isopropanol solution are placed on the fabric and left for 10 seconds. If no penetration has occurred, the fabric is judged to "pass" this level of repellency and the next higher numbered test solution is tested. The fabric rating is the highest numbered test solution that does not wet the fabric. A rating of 0 indicates no water repellency, a higher rating indicates better water repellency.

The water/isopropanol mixtures have the following compositions:

| DuPont Water Repellency | Composition Wt. % | |
|---|---|---|
| Rating Number | Water | Isopropanol |
| 1 | 98 | 2 |
| 2 | 95 | 5 |
| 3 | 90 | 10 |
| 4 | 80 | 20 |
| 5 | 70 | 30 |
| 6 | 60 | 40 |
| 7 | 50 | 50 |
| 8 | 40 | 60 |
| 9 | 30 | 70 |
| 10 | 20 | 80 |

Test Method 2. Water Resistance: Hydrostatic Pressure Test

This method is as described in the American Association of Textile Chemists and Colorists (AATCC) Test Method No. 127 and determines the pressure resistance of the fabric to penetration by a column of water.

Test Method 3. Water Resistance with Carpet

The term "secured" as used in Test Methods 3 and 4 is defined above and is used to describe the attachment of the underlay by means of staples, nails, or other mechanical means of attachment specifically excluding the use of adhesive or adhesive tape.

This method simulates the water resistance of an underlay at the point where it is secured to the underneath flooring for a small water spill on the carpet, i.e., where most of the water spill is contained within the carpet pile and latex).

On a 12×12 in. (30.5×30.5 cm) sample of wood or particle board having a thickness of approximately ½ to 1 in. (1.3 to 2.5 cm), place a 12×12 in. (30.5×30.5 cm) sample of foam padding. Over the padding, place a sheet of white absorbent paper towel. Over the paper towel, place the underlay sample and secure through the underlay, the paper towel, and the foam padding into the wood. Center a 12×12 in. (30.5×30.5 cm) sample of carpeting with a water permeable backing over the securement. The carpeting used is a 1000 g/m$^2$ (30 oz. per square yard) cut pile residential carpet with a water permeable styrene butadiene rubber latex backing. Pour 20 ml of water, adjusted to room temperature (70–80° F., 21–27° C.) onto the carpet sample through a cylinder of about 4 cm diameter and from a height of about 6 cm to create a circular puddle. Remove the cylinder and let the sample stay undisturbed for 30 minutes. Remove any standing surface water, then remove the carpet, remove the underlay, and measure the diameter of any water spot on the towel. The sample will be termed as resistant to water, or a "pass", only if none or a very slight amount of water has passed through the underlay sample. A wet spot diameter of one inch (2.54 cm) or less is required for the underlay to be resistant to water.

Test Method 4. Water Impermeability Without Carpet

The term "secured" as used in Test Methods 3 and 4 is defined above and is used to describe the attachment of the underlay by means of staples, nails, or other mechanical means of attachment specifically excluding the use of adhesive or adhesive tape.

This method simulates the impermeability of an underlay at the point where it is secured to the underneath flooring for a large water spill on the carpet, i.e., where most of the water spill penetrates the carpet pile and latex and puddles on the underlay, especially at the location of the securement.

On a 12×12 in. (30.5×30.5 cm) sample of wood or particle board of approximate thickness ½–1 in. (1.3–2.5 cm), place a 12×12 in. (30.5×30.5 cm) sample of foam padding. Over the padding, place a sheet of white absorbent paper towel. Over the paper towel, place the underlay sample and secure through the underlay, the paper towel, and the foam padding into the wood. Pour 20 ml of water, adjusted to room temperature (70–80° F., 21–27° C.) onto the underlay through a cylinder of about 4 cm diameter and from a height of about 6 cm to create a circular puddle over the securement. Remove the cylinder and let the sample stay undisturbed for 10 minutes. Remove any standing surface water, then remove the underlay, and measure the diameter of any water spot on the towel. The sample will be termed as impermeable to water, or a "pass", only if none or a very slight amount of water has passed through the underlay sample. A wet spot diameter of one inch (2.54 cm) or less is required for the underlay to be impermeable to water.

Test Method 4 is more stringent than Test Method 3 since, in Test Method 3, the tendency for water to penetrate is reduced as it is at least partially absorbed by the carpet.

MATERIALS AND APPLICATION METHODS

The following materials obtained from the sources listed and the following application methods were used in the examples.

Staples:

1) Arrow Fasteners (Saddlebrook N.J.),

2) Hunt Manufacturing Co. (Statesville N.C.).

Underlay Fabrics listed in Table 3:

1) "SONTARA" fabrics from E. I. du Pont de Nemours & Company, Wilmington, Del.

2) "TYVEK" (a low denier thermally embossed flash spun polyethylene fabric) from E. I. du Pont de Nemours and Company, Wilmington Del.

3) SMS (spunbond/meltblown/spunbond fabrics) are commercially manufactured by Kimberly-Clark Corporation (Neenah, Wis.) and BBA Nonwovens (Simpsonville, S.C.)

4) Syn Ind RB400 and RB406 from Synthetic Industries (Ringgold Ga.),

5) Other sources are Chicopee (New Brunswick N.J.), Johnson & Johnson (New Brunswick N.J.), PGI Nonwovens (Dayton N.J.), resin bonded wet laid nonwoven fabric available from The Dexter Corporation (Windsor Locks, Conn.).

6) Other nonwoven examples include products which include needle punched, chemically bonded carded webbed and thermally bonded carded webbed fabrics.

Films:

1) Polyethylene terephthalate (PET) from Carlisle Plastics (Minneapolis, Minn.).

Padding Materials listed in Table 8:

1) General Felt Industries (GFI, Linwood Pa.),

2) The Carpenter Co (Richmond Va.).

In the application of water repellent finishes (WRF) to underlay fabrics, the optimum process depends on the particulars of the fabric and the WRF with regard to the choice of solvent, wet pick up, amount of WRF applied, drying and curing temperature. The following procedures represent the two methods used in these examples for application of fluorochemical and/or wax repellents to the fabrics to produce the impermeable carpet underlays. Immersion application of a water repellent finish is generally preferred over spray application because the immersion process gives a more uniform application of the hydrophobic coating and thus a higher level of water repellency (Test Method 1) and a higher level of resistance to hydrostatic water pressure (Test Method 2).

In the first application process, the fabric was saturated with a 1:1 mixture of water and repellent solution by immersing the fabric in the mixture and the liquid content was reduced by squeezing to approximately 200% by weight of the fabric. The treated fabric was dried at approximately 80° C. (1 80° F.) for 10 min. and cured at approximately 150° C. (300° F.) for 3 min.

In the second application process, the fabric was sprayed uniformly, using conventional spray methods, with approximately 200% by weight of the fabric of a 1:1 mixture of water and repellent solution. The treated fabric was dried as in the immersion process above.

TABLE 3

Description of Underlay Fabrics (Unfinished).

| Fabric No. | Description (See also Materials Section) | weight ($g/m^2$) | Fabric commercial name |
|---|---|---|---|
| FAB-1 | Spunlaced nonwoven PET and wood pulp fibers | 71 | "SONTARA" 8830 |
| FAB-2 | Spunlaced nonwoven PET and wood pulp fibers | 70 | "SONTARA" 8827 |
| FAB-3 | Spunlaced nonwoven PET and wood pulp fibers | 122 | "SONTARA" 8805 |
| FAB-4 | Spunlaced nonwoven PET fibers | 108 | "SONTARA" 8007 |
| FAB-5 | Spunlaced nonwoven PET fibers | 135 | "SONTARA" 8100 |
| FAB-6 | PET needlepunched nonwoven | 130 | Syn Ind RB400 |
| FAB-7 | PET needlepunched nonwoven | 150 | Syn Ind RB406 |
| FAB-8 | Woven 65/35 PET/cotton blend | 100 | Retail* |
| FAB-9 | Knitted acrylic | 180 | Retail* |
| FAB-10 | Knitted PET | 100 | Retail* |
| FAB-11 | Knitted acetate | 110 | Retail* |
| FAB-12 | Knitted 85/15 Lycra-Spandex | 160 | Retail* |
| FAB-13 | Woven wool | 260 | Retail* |
| FAB-14 | Woven nylon | 100 | Retail* |
| FAB-15 | Woven cotton | 140 | Retail* |
| FAB-16 | Nonwoven PET spunbond | 75 | Experimental sample |
| FAB-17 | SMS thermally bonded laminate | 52 | Kimberly-Clark |
| FAB-18 | Flash spun polyethylene nonwoven | 42 | "TYVEK" |
| FAB-19 | Unbleached paper | 60 | — |

*Purchased at a retail store.

TABLE 4

List of Water Repellent Finishes (WRF) Used on Underlay Fabrics for Examples 20–86

| Finish | Repellent Description |
|---|---|
| WRF-1 | A fluoroalkyl urethane as disclosed in U.S. Pat. No. 4,595,518. |
| WRF-2 | A blend of wax, a diethylaminoethyl methacrylate/hexadecyl methacrylate/octadecyl methacrylate copolymer and a fluoroalkyl methacrylate copolymer of the type disclosed in U.S. Pat. No. 4,595,518. |
| WRF-3 | Aqueous dispersion of a hydrocarbon wax. |
| WRF-4 | Blend of fluoroalkyl citrate-urethane and polymethylmethacrylate as disclosed in U.S. Pat. No. 3,923,715. |
| WRF-5 | Polyfluoro organic compound prepared by reacting a polyisocyanate with a fluoroalcohol and water as disclosed in EP-A-453641. |
| WRF-6 | A fluoroalkyl polyacrylate as disclosed in U.S. Pat. No. 4,742,140. |
| WRF-7 | A fluoroalkyl polymethacrylate as disclosed in U.S. Pat. No. 5,344,903. |
| WRF-8 | Perfluoroalkyl methacrylate polymer of the type disclosed in U.S. Pat. No. 5,674,961. |

EXAMPLES

Comparative Examples A–S (No Repellent Finish)

A number of fabrics that were not finished with any water repellent or hydrophobic finish were tested for water repellency (Test Method 1) and water resistance to hydrostatic pressure (Test Method 2). As expected, none of the fabrics demonstrated any measurable repellency or resistance to water. These fabrics were then tested for impermeability to water as a carpet underlay between foam padding and broadloom carpeting. For each fabric tested according to Test Methods 3 and 4, ½ (1.3 cm) thick GFI polyurethane foam padding (460 g/m2) was used. For Test Methods 3 and 4, the fabrics were secured through the foam padding to the underneath particle board with a ½ (1.3 cm) staple using a standard staple gun. As expected, Table 5 shows that none of the unfinished fabrics FAB-1–FAB-19 provided any water impermeability to larger water spills (Test Method 4—without carpet). Only comparative Examples Q and R, film-like nonwoven fabrics, provided any water resistance to small water spills (Test Method 3—with carpet).

TABLE 5

Test Results for Comparative Bxamples A–S (Unfinished Underlay Fabrics)

| Comp. Ex. | Underlay Fabric # | Test Method 1 | 2 | 3 | 4 |
|---|---|---|---|---|---|
| A | FAB-1 | 0 | 0 | Fail | Fail |
| B | FAB-2 | 0 | 0 | Fail | Fail |
| C | FAB-3 | 0 | 0 | Fail | Fail |
| D | FAB-4 | 0 | 0 | Fail | Fail |
| E | FAB-5 | 0 | 0 | Fail | Fail |
| F | FAB-6 | 0 | 0 | Fail | Fail |
| G | FAB-7 | 0 | 0 | Fail | Fail |
| H | FAB-8 | 0 | 0 | Fail | Fail |
| I | FAB-9 | 0 | 0 | Fail | Fail |
| J | FAB-10 | 0 | 0 | Fail | Fail |
| K | FAB-11 | 0 | 0 | Fail | Fail |
| L | FAB-12 | 0 | 0 | Fail | Fail |
| M | FAB-13 | 0 | 0 | Fail | Fail |
| N | FAB-14 | 0 | 0 | Fail | Fail |
| O | FAB-15 | 0 | 0 | Fail | Fail |
| P | FAB-16 | 0 | 0 | Fail | Fail |
| Q | FAB-17 | NA | NA | Pass | Fail |
| R | FAB-18 | NA | NA | Pass | Fail |
| S | FAB-19 | 0 | 0 | Fail | Fail |

Examples 1–19

A series of polyester films of varying thicknesses were tested for water resistance (Test Method 3) and water impermeability (Test Method 4) as carpet underlays. For each film tested according to Test Methods 3 and 4, ½ (1.3 cm) thick GFI polyurethane foam padding (460 g/m$^2$) was used. For Test Methods 3 and 4, the fabrics were secured through the foam padding to the underneath particle board with either (1) ½ (1.3 cm) staple using a standard staple gun or (2) various sized nails using a standard hammer. As shown in Table 6 for some examples washers around the head of the nail were used or tape over either the staples or the nail head was used. Impermeable films do not require any water repellent finish. Table 6 shows that an impermeable film, e.g., those made from a polyester such as polyethylene terephthalate (PET), can be used as water resistant or water impermeable carpet underlay if it is secured to the flooring in a way that does not compromise the water resistant or water impermeable barrier.

TABLE 6

Carpet Film Underlays of Impermeable Film
Securement codes are listed in Table 2.
No water repellent finish is used on impermeable films.

| Ex # | PET film thickness mils (μm) | Securement: Staple length in. (cm) | Nail | Washer | Tape | Test Method 3 | Test Method 4 |
|---|---|---|---|---|---|---|---|
| 1 | 0.36 (9) | ½ (1.3) | — | — | — | Pass | Fail |
| 2 | 0.74 (19) | ½ (1.3) | — | — | — | Pass | Fail |
| 3 | 1 (25) | ½ (1.3) | — | — | — | Pass | Fail |
| 4 | 2 (51) | ½ (1.3) | — | — | — | Pass | Fail |
| 5 | 4 (102) | ½ (1.3) | — | — | — | Pass | Fail |
| 6 | 6 (152) | ½ (1.3) | — | — | — | Pass | Fail |
| 7 | 4 (102) | ½ (1.3) | — | — | T1 | Pass | Pass |
| 8 | 4 (102) | ½ (1.3) | — | — | T2 | Pass | Pass |
| 9 | 4 (102) | ½ (1.3) | — | — | T3 | Pass | Pass |
| 10 | 4 (102) | — | N1 | — | — | Pass | Pass |
| 11 | 4 (102) | — | N2 | — | — | Pass | Pass |
| 12 | 4 (102) | — | N3 | — | — | Pass | Pass |
| 13 | 4 (102) | — | N1 | W1 | — | Pass | Pass |
| 14 | 4 (102) | — | N1 | W2 | — | Pass | Pass |
| 15 | 4 (102) | — | N1 | W3 | — | Pass | Pass |
| 16 | 4 (102) | — | N1 | W4 | — | Pass | Pass |
| 17 | 4 (102) | — | N1 | W5 | — | Pass | Pass |
| 18 | 4 (102) | — | N1 | W6 | — | Pass | Pass |
| 19 | 4 (102) | — | N1 | W7 | — | Pass | Pass |

The illustrative examples in Table 6 support the following conclusions. Examples 1–6 showed that the installation of impermeable films having a thickness of 0.36 to 6 mils (9 to 152 micrometers) gave only water resistance to water spills when installed using staples. Examples 7–9 showed that the installation of impermeable films gave water resistance and impermeability to water spills when installed using staples if the staple holes were sealed with tape. Examples 10–12 showed that the installation of impermeable films gave water resistance and impermeability to water spills when installed using nails only. Examples 13–19 showed that the installation of impermeable films gave water resistance and impermeability to water spills when installed using nails with washers under the head of the nails to seal the nail hole. When comparing examples 1–6 with examples 10–19, installation of impermeable films using nails provided better water impermeability to water spills than when installing impermeable films using staples.

Examples 20–73

A series of underlay fabrics, treated with various water repellent finishes were tested for water resistance (Test Method 3) and water impermeability (Test Method 4) as carpet underlays.

Table 7 shows the results of various combinations of water repellent finish (WRF), fabrics, and the methods for securing an underlay to the underneath flooring through the padding using either stapling or nailing. The resulting installed carpet underlays demonstrated (1) water repellency, (2) water resistance to hydrostatic pressure, (3) water resistance to water spills, and optionally (4) impermeability to water spills, as shown by Test Methods 1, 2, 3, and optionally Test Method 4, respectively. For all the items described in Table 7 and tested according to Test Methods 3 and 4, ½ (1.3 cm) thick GFI polyurethane foam padding (460 g/m2) was used. For Test Methods 3 and 4, the fabrics were secured through the foam padding to the underneath particle board with either (1) various sized staples using a standard staple gun with optional tape over the staple or (2) various sized nails using a standard hammer with optional (a) washers around the head of the nail or (b) tape over the nail head to seal the nail hole in the film.

TABLE 7

Water Resistance and Impermeability of Various Underlay Fabrics in Various Installations.
Underlay fabrics are listed in Table 3
Water repellent finishes (WRF) are listed in Table 4.
Securement codes are listed in Table 2.

| Ex. # | Underlay Fabric | WRF # | WRF Process | Securement: Staple Size in. (cm) | Nail | Washer | Tape | Test Method 1 | Test Method 2 | Test Method 3 | Test Method 4 |
|---|---|---|---|---|---|---|---|---|---|---|---|
| 20 | FAB-1 | 7 | imm* | ½ (1.3) | — | — | — | 4 | 22 | Pass | Pass |
| 21 | FAB-2 | 7 | imm | ½ (1.3) | — | — | — | 8 | 26 | Pass | Pass |
| 22 | FAB-3 | 7 | imm | ½ (1.3) | — | — | — | 10 | 20 | Pass | Pass |
| 23 | FAB-4 | 7 | imm | ½ (1.3) | — | — | — | 8 | 13 | Pass | Pass |
| 24 | FAB-5 | 7 | imm | ½ (1.3) | — | — | — | 8 | 11 | Pass | Pass |
| 25 | FAB-1 | 7 | imm | 1/4 (0.6) | — | — | — | 4 | 22 | Pass | Pass |
| 26 | FAB-2 | 7 | imm | ⅜ (1.0) | — | — | — | 8 | 26 | Pass | Pass |
| 27 | FAB-2 | 7 | imm | ⅝ (1.6) | — | — | — | 8 | 26 | Pass | Pass |
| 28 | FAB-2 | 7 | imm | ¾ (1.9) | — | — | — | 8 | 26 | Pass | Pass |

TABLE 7-continued

Water Resistance and Impermeability of Various Underlay Fabrics in Various Installations.
Underlay fabrics are listed in Table 3
Water repellent finishes (WRF) are listed in Table 4.
Securement codes are listed in Table 2.

| Ex. # | Underlay Fabric | WRF # | WRF Process | Securement: Staple Size in. (cm) | Securement: Nail | Securement: Washer | Securement: Tape | Test Method 1 | Test Method 2 | Test Method 3 | Test Method 4 |
|---|---|---|---|---|---|---|---|---|---|---|---|
| 29 | FAB-1 | 7 | imm | 15/16 (2.4) | — | — | — | 4 | 22 | Pass | Pass |
| 30 | FAB-1 | 1 | imm | ½ (1.3) | — | — | — | 4 | 5 | Pass | Fail |
| 31 | FAB-1 | 2 | imm | ½ (1.3) | — | — | — | 8 | 5 | Pass | Fail |
| 32 | FAB-1 | 3 | imm | ½ (1.3) | — | — | — | 5 | 10 | Pass | Pass |
| 33 | FAB-1 | 4 | imm | ½ (1.3) | — | — | — | 5 | 3 | Pass | Fail |
| 34 | FAB-1 | 5 | imm | ½ (1.3) | — | — | — | 6 | <2 | Pass | Fail |
| 35 | FAB-1 | 1 | spray | ½ (1.3) | — | — | — | 4 | <2 | Pass | Fail |
| 36 | FAB-1 | 2 | spray | ½ (1.3) | — | — | — | 6 | <2 | Pass | Fail |
| 37 | FAB-1 | 3 | spray | ½ (1.3) | — | — | — | 4 | <2 | Pass | Fail |
| 38 | FAB-1 | 4 | spray | ½ (1.3) | — | — | — | 5 | <2 | Pass | Fail |
| 39 | FAB-1 | 5 | spray | ½ (1.3) | — | — | — | 5 | <2 | Pass | Fail |
| 40 | FAB-6 | 1 | imm | ½ (1.3) | — | — | — | 6 | <2 | Pass | Fail |
| 41 | FAB-7 | 1 | imm | ½ (1.3) | — | — | — | 6 | <2 | Pass | Fail |
| 42 | FAB-8 | 1 | imm | ½ (1.3) | — | — | — | 4 | <2 | Pass | Fail |
| 43 | FAB-9 | 1 | imm | ½ (1.3) | — | — | — | 5 | <2 | Pass | Fail |
| 44 | FAB-10 | 1 | imm | ½ (1.3) | — | — | — | 4 | <2 | Pass | Fail |
| 45 | FAB-11 | 1 | imm | ½ (1.3) | — | — | — | 3 | <2 | Pass | Fail |
| 46 | FAB-12 | 1 | imm | ½ (1.3) | — | — | — | 5 | <2 | Pass | Fail |
| 47 | FAB-13 | 1 | imm | ½ (1.3) | — | — | — | 6 | <2 | Pass | Fail |
| 48 | FAB-14 | 1 | imm | ½ (1.3) | — | — | — | 4 | <2 | Pass | Fail |
| 49 | FAB-15 | 1 | imm | ½ (1.3) | — | — | — | 6 | 5 | Pass | Pass |
| 50 | FAB-16 | 6 | imm | ½ (1.3) | — | — | — | 6 | 30 | Pass | Pass |
| 51 | FAB-17 | 6 | imm | ½ (1.3) | — | — | — | 6 | 20 | Pass | Fail |
| 52 | FAB-18 | 6 | imm | ½ (1.3) | — | — | — | 3 | 24 | Pass | Fail |
| 53 | FAB-2 | 7 | imm | — | N4 | — | — | 8 | 26 | Pass | Pass |
| 54 | FAB-2 | 7 | imm | — | N5 | — | — | 8 | 26 | Pass | Pass |
| 55 | FAB-2 | 7 | imm | — | N6 | — | — | 8 | 26 | Pass | Pass |
| 56 | FAB-1 | 2 | imm | — | N3 | — | — | 8 | 5 | Pass | Pass |
| 57 | FAB-1 | 2 | imm | — | N1 | — | — | 8 | 5 | Pass | Pass |
| 58 | FAB-1 | 1 | imm | — | N3 | — | — | 4 | 5 | Pass | Pass |
| 59 | FAB-1 | 1 | imm | — | N1 | — | — | 4 | 5 | Pass | Pass |
| 60 | FAB-17 | 6 | imm | — | N3 | — | — | 6 | 20 | Pass | Pass |
| 61 | FAB-17 | 6 | imm | — | N1 | — | — | 6 | 20 | Pass | Pass |
| 62 | FAB-18 | 6 | imm | — | N3 | — | — | 3 | 24 | Pass | Pass |
| 63 | FAB-18 | 6 | imm | — | N1 | — | — | 3 | 24 | Pass | Pass |
| 64 | FAB-1 | 4 | imm | — | N1 | W1 | — | 5 | 3 | Pass | Pass |
| 65 | FAB-1 | 5 | imm | — | N1 | W4 | — | 6 | <2 | Pass | Pass |
| 66 | FAB-1 | 2 | imm | — | N1 | W7 | — | 8 | 5 | Pass | Pass |
| 67 | FAB-1 | 5 | imm | ½ (1.3) | — | — | T1 | 6 | <2 | Pass | Pass |
| 68 | FAB-1 | 2 | imm | ½ (1.3) | — | — | T1 | 8 | 5 | Pass | Pass |
| 69 | FAB-1 | 4 | imm | ½ (1.3) | — | — | T1 | 5 | 3 | Pass | Pass |
| 70 | FAB-19 | 8 | imm | ½ (1.3) | — | — | — | 5 | 30 | Pass | Fail |
| 71 | FAB-19 | 8 | imm | — | N1 | — | — | 5 | 30 | Pass | Pass |
| 72 | FAB-19 | 8 | imm | ½ (1.3) | — | — | T1 | 5 | 30 | Pass | Pass |
| 73 | FAB-19 | 8 | imm | ½ (1.3) | — | — | T3 | 5 | 30 | Pass | Pass |

*imm: immersion application process.

The illustrative examples in Table 7 support the following conclusions.

Examples 20–73 showed that many fabrics treated with different water repellent finishes gave resistance to water spills when installed as carpet underlays using either staples or nails. Examples 53–63 showed that many different kinds of nails can be used to install fabrics treated with water repellent finishes as carpet underlays in a way that provided both water resistance and water impermeability to spills. Examples 20–21 and 25–29 showed that many different sizes of staples can be used to install fabrics treated with water repellent finishes as carpet underlays to provide both water resistance and water impermeability to spills. Comparing examples 30–31 with examples 56–59 and comparing examples 51–52 with examples 60–63 showed that installation of water repellent finished fabrics using nails provided better water impermeability than when installing water repellent finished fabrics using staples. Examples 20, 32, 49, 50, 56, and 64–69 showed that fabrics treated with different kinds of water repellent finishes (i.e., fluorochemicals and/or waxes) gave both water resistance and water impermeability to spills when installed as a carpet underlay in accordance with the process of the present invention. Comparing examples 64–66 to examples 31, 33, and 34 showed that, when nails were used to install water repellent finished fabrics as carpet underlays, the use of various washers to seal the nail holes preserved water impermeability. Comparing examples 67–69 to examples 31, 33, and 34 showed that, when staples were used to install water repellent finished fabrics as carpet underlays, the use of various tapes to seal the staple holes restored water impermeability. Examples 71–73 showed that the installation of cellulosic fabrics treated with a water repellent finish gave water resistance and water impermeability when installed using either nails or staples if the staple holes were sealed with tape. Example 70 showed that the installation of cellulosic fabric treated with a water repellent finish gave only water resistance when installed using staples without the staple holes sealed with tape.

Examples 74–86

Underlay fabrics, treated with various water repellent finishes, were secured over various padding materials and tested for water resistance (Test Method 3) and water impermeability (Test Method 4) as carpet underlays.

Table 8 shows the effectiveness of the water impermeability of carpet underlays when installed over various kinds of carpet padding. Spunlaced nonwovens made from PET and wood pulp fibers (the fabrics used in Comparative Examples A or B) were treated with a fluorochemical water repellent finish (WRF-7) by immersion application, installed over a series of carpet paddings, and tested for water resistance (Test Method 3) and water impermeability (Test Method 4). For Test Method 3 and 4, the fabrics were secured through the foam padding to the underneath particle board with various staples using a standard staple gun. Padding made from polyurethane foam, Rebond (chopped foam), Styrofoam, synthetic fibers, and sponge rubber all worked effectively under a water impermeable carpet underlay installed using the process of the present invention. Padding thicknesses from 1/16 in. (0.16 cm) to 4 in. (10.2 cm) and from 140 to 4080 g/m2 all worked effectively under a water impermeable carpet underlay installed using the process of the present invention.

TABLE 8

Water Resistance and Impermeability of Carpet Paddings in Various Installations.

| Ex. # | Underlay Fabric | WRF # | Staple Size in.* | Padding Thickness [in. (cm)]/ Material/Density | Test Method 1 | 2 | 3 | 4 |
|---|---|---|---|---|---|---|---|---|
| | | | | Underlay fabrics are listed in Table 3 Water repellent finishes (WRF) are listed in Table 4. | | | | |
| 74 | FAB-1 | 7 | ½ | 1/16 (0.16)/polyurethane/140 g/m$^2$ | 4 | 22 | Pass | Pass |
| 75 | FAB-1 | 7 | ½ | ⅛ (0.3)/polyurethane/300 g/m$^2$ | 4 | 22 | Pass | Pass |
| 76 | FAB-1 | 7 | ½ | ½ (1.3)/polyurethane/160 g/m$^2$ | 4 | 22 | Pass | Pass |
| 77 | FAB-1 | 7 | ½ | 1 (2.5)/polyurethane/420 g/m$^2$ | 4 | 22 | Pass | Pass |
| 78 | FAB-1 | 7 | ½ | 4 (10.2)/polyurethane/1160 g/m$^2$ | 4 | 22 | Pass | Pass |
| 79 | FAB-2 | 7 | ½ | 7/16 (1.1)/chopped foam/1040 g/m$^2$ | 8 | 26 | Pass | Pass |
| 80 | FAB-2 | 7 | ½ | 7/16 (1.1)/chopped foam/1560 g/m$^2$ | 8 | 26 | Pass | Pass |
| 81 | FAB-2 | 7 | ½ | ¾ (1.9)/STYROFOAM/670 g/m$^2$ | 8 | 26 | Pass | Pass |
| 82 | FAB-1 | 7 | 3/8 | 1/16 (0.16)/polyurethane/140 g/m$^2$ | 4 | 22 | Pass | Pass |
| 83 | FAB-1 | 7 | 3/8 | 1 (2.5)/polyurethane/420 g/m$^2$ | 4 | 22 | Pass | Pass |
| 84 | FAB-1 | 7 | ½ | ⅜ (1.0)/synthetic fiber cushion/ 970 g/m$^2$ | 4 | 22 | Pass | Pass |
| 85 | FAB-1 | 7 | ½ | ⅜ (1.0)/sponge rubber padding/ 2600 g/m$^2$ | 4 | 22 | Pass | Pass |
| 86 | FAB-1 | 7 | ½ | ½ (1.3)/sponge rubber cushion/ 4080 g/m$^2$ | 4 | 22 | Pass | Pass |

*For metric equivalents for staple lengths, See Table 6.

What is claimed is:

1. A process for installing a carpet underlay resistant to water comprising a) placing a padding over a flooring, and securing said padding into the flooring, b) placing an underlay over said padding, and c) mechanically securing the underlay through said padding into the flooring with fasteners, wherein said underlay comprises a water resistant film, or a fabric having been treated with a water repellent finish, said underlay being resistant to water whereby 20 ml of water poured on a test sample of carpet over the underlay at a location over an underlay fastener from a height of 6 cm makes no wet spot after thirty minutes, or a wet spot having a diameter of a maximum of 2.54 cm, on a paper towel placed between the underlay and the padding directly beneath the location on which said water has been poured.

2. A process for installing a carpet underlay impermeable to water comprising a) placing a padding over a flooring, and securing said padding into the flooring, b) placing an underlay over said padding, and c) mechanically securing the underlay through said padding into the flooring with fasteners, wherein said underlay comprises a water impermeable film, or a fabric treated with a water repellent finish, said underlay being impermeable to water whereby 20 ml of water poured on a test sample of said underlay at a location over an underlay fastener from a height of 6 cm makes no wet spot after 10 minutes, or a wet spot having a diameter of a maximum of 2.54 cm, on a paper towel placed between the underlay and the padding directly beneath the location on which said water has been poured.

3. The process of claim 1 or 2 further comprising installing a carpet over said underlay.

4. The process of claim 1 or 2 further comprising placing the underlay in at least two segments in a manner to create an overlap at a seam between the segments, and mechanically securing the segments through the padding and into the flooring with fasteners at the location of the overlap.

5. The process of claim 1 or 2 wherein the fasteners are nails, nails with washers, staples, taped-over staples, or taped-over nails.

6. The process of claim 1 or 2 wherein the water resistant or water impermeable underlay fabric comprises 1) a woven fabric, 2) a knitted fabric, 3) a paper or 4) a nonwoven fabric, said nonwoven fabric selected from the group consisting of spunbonded webs, spunlaced webs, meltblown webs, resin bonded fabrics, random laid fiber webs, tissue laminates, scrim laminates, dry laid webs, and needlepunched fabrics.

7. The process of claim 4 wherein the underlay fabric comprises fibers selected from the group consisting of cotton, wool, jute, polyolefin, acrylic polymers, cellulosic, nylon, polyester, and mixtures thereof.

8. The process of claim 1 or 2 wherein the underlay fabric is treated with a water repellent finish composition comprising at least one of fluorochemicals, silicones, wax emulsions, naturally occurring oils, alkylacrylate resins, or hydrophobic alkylmethacrylate resins.

9. The process of claim 1 or 2 wherein the underlay fabric comprises a spunlaced nonwoven treated with a water repellent finish composition comprising a fluorochemical.

10. The process of claim 1 or 2 wherein the underlay fabric comprises a laminate of spunbound/melt blown/spunbound nonwoven fabrics treated with a water repellent finish composition comprising a fluorochemical.

11. The process of claim 1 or 2 wherein the underlay is a film, said film selected from the group consisting of acrylic, polyolefin, polyester, polyethylene-vinyl acetate, polycarbonate, cellulose acetate, fluoroplastic, polystyrene, polyvinyl chloride, and nylon.

12. A process for installing a carpet underlay resistant to water comprising a) placing a padding over a flooring, b) placing an underlay over said padding, and c) mechanically securing the underlay through said padding into the flooring with fasteners, wherein said underlay comprises a water resistant film, or a fabric treated with a water repellent finish, said underlay being resistant to water whereby 20 ml of water poured on a test sample of carpet over the underlay at a location over an underlay fastener from a height of 6 cm makes no wet spot after thirty minutes, or a wet spot having a diameter of a maximum of 2.54 cm, on a paper towel placed between the underlay and the padding directly beneath the location on which said water has been poured.

13. A process for installing a carpet underlay impermeable to water comprising a) placing a padding over a flooring, b) placing an underlay over said padding, and c) mechanically securing the underlay through said padding into the flooring with fasteners, wherein said underlay comprises a water impermeable film, or a fabric treated with a water repellent finish, said underlay being impermeable to water whereby 20 ml of water poured on a test sample of said underlay at a location over an underlay fastener from a height of 6 cm makes no wet spot after 10 minutes, or a wet spot having a diameter of a maximum of 2.54 cm, on a paper towel placed between the underlay and the padding directly beneath the location on which said water has been poured.

14. The process of claim 12 or 13 further comprising installing a carpet over said underlay.

15. The process of claim 12 or 13 further comprising placing the underlay in at least two segments in a manner to create an overlap at a seam between the segments, and mechanically securing the segments through the padding and into the flooring with fasteners at the location of the overlap.

16. The process of claim 12 or 13 wherein the fasteners are nails, nails with washers, staples, taped-over staples, or taped-over nails.

17. The process of claim 12 or 13 wherein the water resistant or water impermeable underlay fabric comprises 1) a woven fabric, 2) a knitted fabric, 3) a paper or 4) a nonwoven fabric, said nonwoven fabric selected from the group consisting of spunbonded webs, spunlaced webs, meltblown webs, resin bonded fabrics, random laid fiber webs, tissue laminates, scrim laminates, dry laid webs, and needlepunched fabrics.

18. The process of claim 16 wherein the underlay fabric comprises fibers selected from the group consisting of cotton, wool, jute, polyolefin, acrylic polymers, cellulosic, nylon, polyester, and mixtures thereof.

19. The process of claim 12 or 13 wherein the underlay fabric is treated with a water repellent finish composition comprising at least one of fluorochemicals, silicones, wax emulsions, naturally occurring oils, alkylacrylate resins, or hydrophobic alkylmethacrylate resins.

20. The process of claim 12 or 13 wherein the underlay fabric comprises a spunlaced nonwoven treated with a water repellent finish composition comprising a fluorochemical.

21. The process of claim 12 or 13 wherein the underlay fabric comprises a laminate of spunbound/melt blown/spunbound nonwoven fabrics treated with a water repellent finish composition comprising a fluorochemical.

22. The process of claim 12 or 13 wherein the underlay is a film, said film selected from the group consisting of acrylic, polyolefin, polyester, polyethylene-vinyl acetate, polycarbonate, cellulose acetate, fluoroplastic, polystyrene, polyvinyl chloride, and nylon.

23. A carpet underlay installed according to the process of claim 1, 2, 12 or 13.

* * * * *